US007284962B2

(12) United States Patent
Blakey

(10) Patent No.: US 7,284,962 B2
(45) Date of Patent: Oct. 23, 2007

(54) MICROPUMP

(75) Inventor: David Mark Blakey, Hertfordshire (GB)

(73) Assignee: The Technology Partnership PLC, Hertfordshire (GB)

( * ) Notice: Subject to any disclaimer, the term of this patent is extended or adjusted under 35 U.S.C. 154(b) by 162 days.

(21) Appl. No.: 10/478,670

(22) PCT Filed: May 24, 2002

(86) PCT No.: PCT/GB02/02452

§ 371 (c)(1),
(2), (4) Date: Nov. 24, 2003

(87) PCT Pub. No.: WO02/097270

PCT Pub. Date: Dec. 5, 2002

(65) Prior Publication Data

US 2004/0146407 A1 Jul. 29, 2004

(30) Foreign Application Priority Data

May 25, 2001 (GB) ..... 0112784.4

(51) Int. Cl.
*F04B 43/12* (2006.01)

(52) U.S. Cl. ..... 417/53; 417/413.2; 417/480

(58) Field of Classification Search ..... 417/322, 417/530, 413.2, 480, 555.1, 545, 53; 137/527, 137/540, 508

See application file for complete search history.

(56) References Cited

U.S. PATENT DOCUMENTS

| | | | | |
|---|---|---|---|---|
| 2,249,971 | A * | 7/1941 | Mecorney | 137/537 |
| 4,045,009 | A * | 8/1977 | Pees | 267/139 |
| 5,085,562 | A * | 2/1992 | van Lintel | 417/413.3 |
| 5,224,843 | A * | 7/1993 | van Lintel | 417/413.2 |
| 5,261,601 | A | 11/1993 | Ross et al. | 239/102.2 |
| 5,938,117 | A | 8/1999 | Ivri | 239/4 |
| 6,401,749 | B1 * | 6/2002 | Tai et al. | 137/540 |
| 6,668,849 | B2 * | 12/2003 | Onstenk et al. | 137/1 |
| 6,817,374 | B2 * | 11/2004 | Onstenk et al. | 137/1 |

FOREIGN PATENT DOCUMENTS

| | | |
|---|---|---|
| DE | 4132930 | 8/1993 |
| EP | 0 815 931 | 1/1998 |
| FR | 929947 | 1/1948 |
| FR | 1264613 | 5/1961 |
| WO | 96/31289 | 10/1996 |
| WO | 00/18670 | 4/2000 |

* cited by examiner

*Primary Examiner*—Anthony Stashick
*Assistant Examiner*—Vikansha Dwivedi

(57) ABSTRACT

This invention provides a fluid pump using perforate elements and closure elements which are alternately displace and relates particularly but not exclusively to miniature fluid pumps and pumps suitable for delivery of liquid pharmaceutical formulations. In the art of miniature liquid pumps are known pumps based on peristaltic and "pump chamber" principles. (Peristaltic pumps may be used to pump fluids in general, that is, liquids or gases). Both types of pump are used in ambulatory pump products for delivery of liquid medicaments, for which application miniaturization and low weight are important attributes.

15 Claims, 8 Drawing Sheets

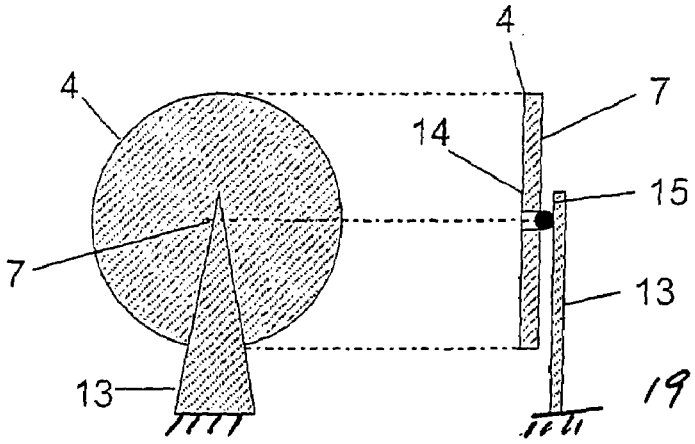
Figure 3
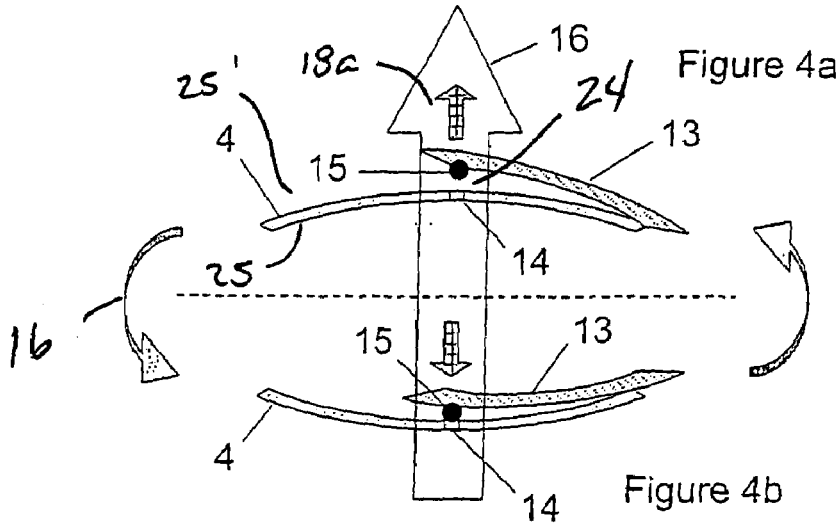
Figure 4a
Figure 4b
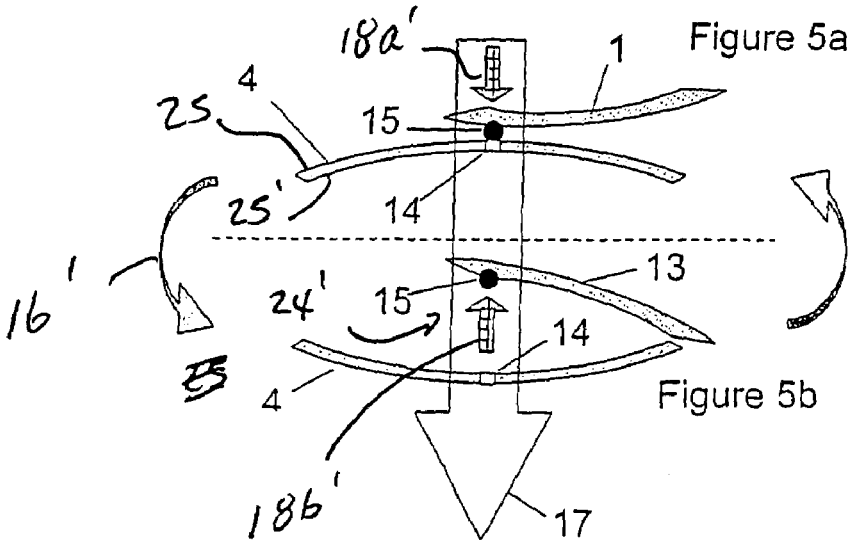
Figure 5a
Figure 5b

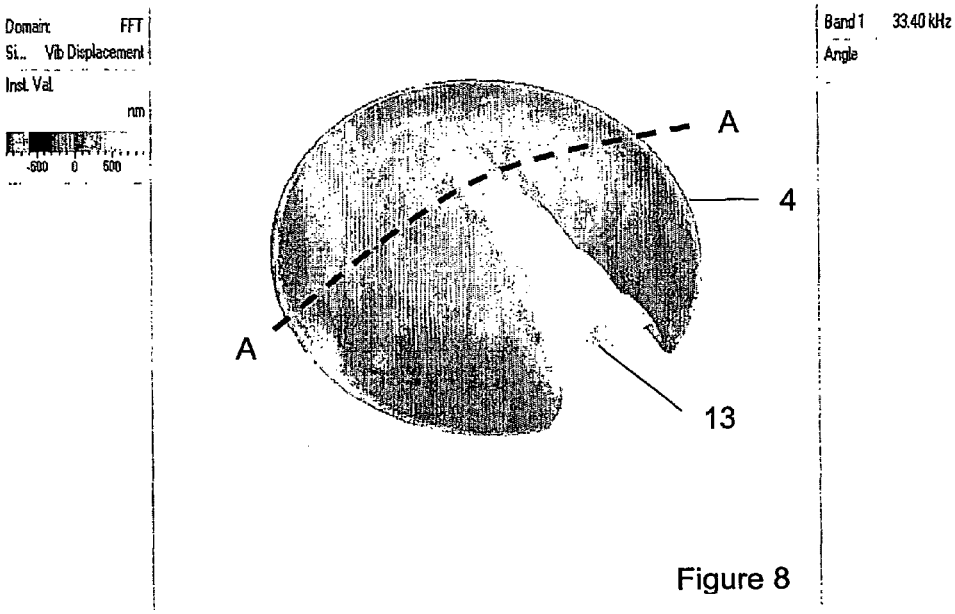
Figure 8
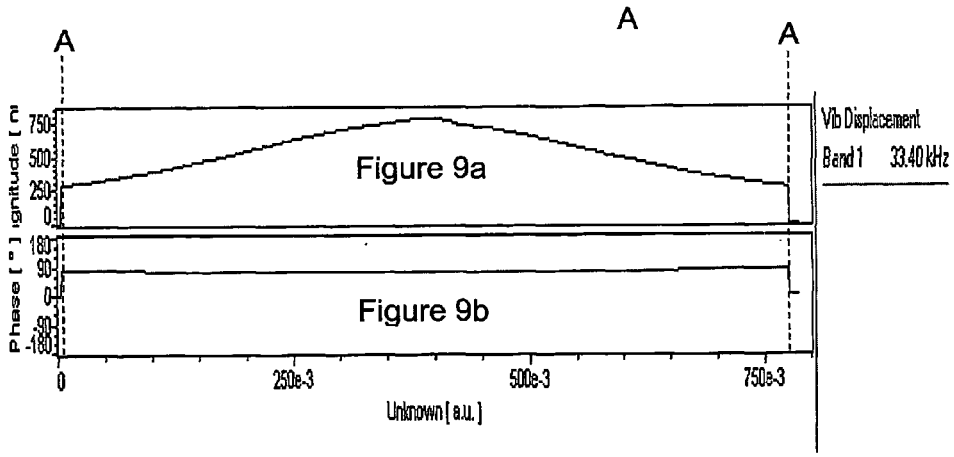

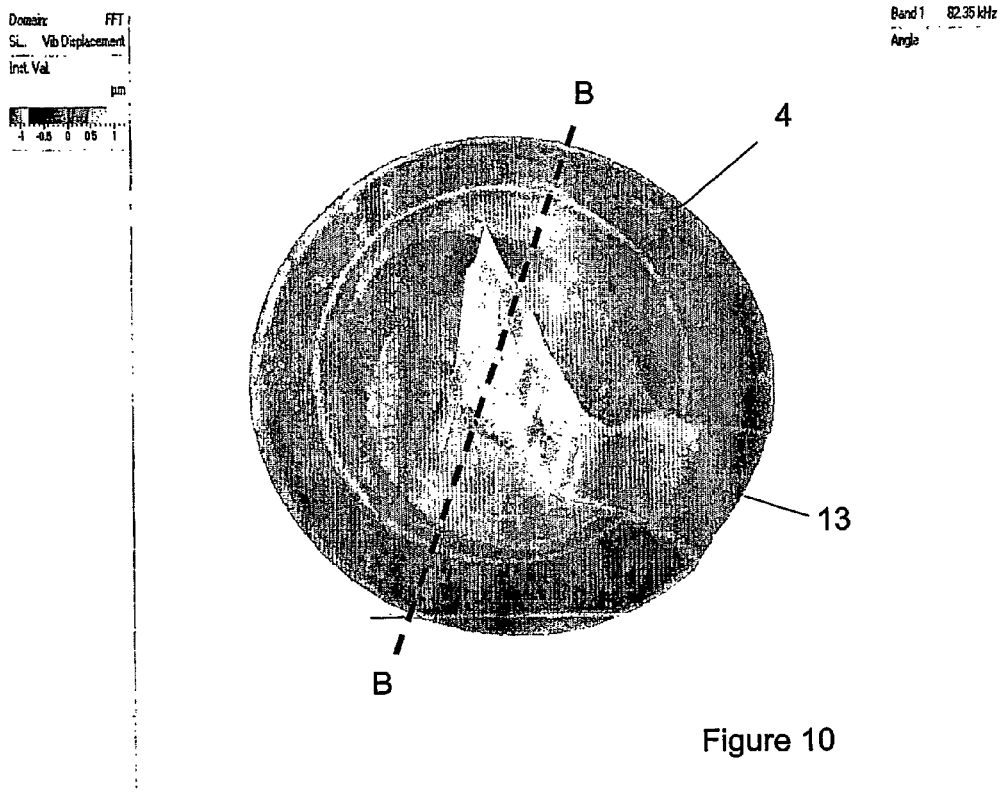
Figure 10
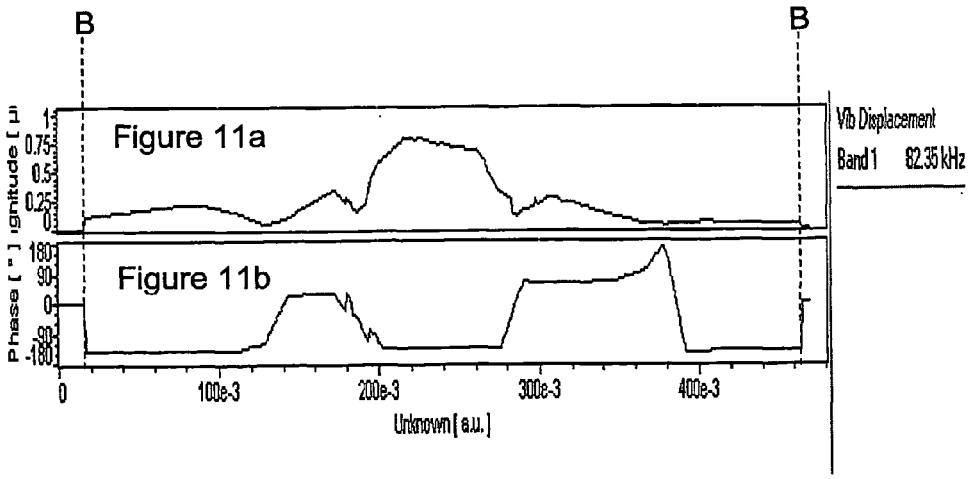

MICROPUMP

The present invention provides a new type of fluid pump apparatus, and one that is particularly suitable for (but not limited to) application in miniature ambulatory liquid drug pumps.

Although not essential in some applications, it is often desirable that the fluid pump ('pump' for short) does not allow 'back-flow'; that is, it does not allow fluid flow in the direction from the pump outlet to the pump inlet. Back-flow can be caused by a relatively high hydrostatic head at the outlet compared to the inlet. This is particularly important in the case of drug pumps, where back-flow can result in fluid loss or sterility issues for the drug reservoir. It is also often desirable that the pump does not allow uncontrolled "forward flow". In the case of drug pumps, uncontrolled forward flow can result in overdosing to the patient.

Fluid naturally flows from a region at which its hydrostatic pressure is high to a region where its hydrostatic pressure is low. This direction of flow is not always desirable; for example, in medicine it is often desirable to introduce liquid drugs into the venous or arterial system of patients, as a means of administering therapy. To improve their quality of life, it is often desirable to do so when they are free to walk, rather than to be confined to a bed. In such a situation, the drug reservoir is often, for practical purposes, desirably attached to the patient's body, and consequently is generally at a hydrostatic pressure that is lower than the patient's venal or arterial pressure. The pump must therefore deliver a volume of fluid (in this case, a liquid drug formulation) from a region of low pressure (the reservoir) at the inlet side of the pump to a region of higher pressure (the patient's bloodstream) at the outlet side of the pump. To do so, the pump must be capable of creating a rise in pressure of the fluid to be pumped and to displace a volume of fluid at that increased pressure, i.e. the pump must be capable of doing hydrostatic work on the fluid. Furthermore, the pump should not allow uncontrolled forward flow either.

This is quite general and so, for the purposes of this specification, we define a fluid pump (whether an ambulatory drug pump or other type of pump) to be an apparatus that is capable of doing work upon a fluid by transporting a volume of that fluid from a first region (the pump inlet) to a second region (the pump outlet). If the mechanism cannot do this, it does no work on the fluid and so, failing in its fundamental function, it is not a fluid pump.

In the art of peristaltic drug pumps, drug formulation is fed from a reservoir to an outlet (which is typically terminated by a needle inserted into a patient) via a length of tubing. In use, a solid body compresses the tubing locally and, whilst maintaining that local compression, the solid body moves along the tubing in the direction from the reservoir to the outlet. The motion of this compressing body displaces fluid against the higher fluid pressure on the outlet side, thereby doing work on the fluid as it does so. This process is repeated, most typically by employing a sequence of such solid bodies in the form of cylindrical rollers mounted off the axis of a rotating shaft to sequentially squeeze and translate along the tube. Each solid body releases from the tube only when the immediately following solid body establishes tube compression on the inlet side of the tube relative to the releasing solid body. In this way, a pumping action is established that does not permit significant 'back-flow'. Since the pipe is always closed, uncontrolled forward flow is not permitted.

Such pumps are well known, but it has proven difficult to miniaturize them to the level desired by many patients using ambulatory pumps. They occasionally have problems of imperfect sealing of the tube (so some back-flow can occur) and fatigue of the tube can occur due to the repeated tube compression; further, the act of compressive translation is energetically lossy and requires significant power consumption, so limiting minimum pump size. Finally, such pumps produce a noticeable and undesirable low-frequency 'pulsatile' flow as the solid bodies move into and out of tube compression.

CH-C-280618 by Sigg describes a pump provided with a chamber having an inlet, an outlet and, disposed between the inlet and the outlet, a plate member which is movable in a reciprocal motion within the chamber. The plate member is provided with a number of nozzles which are shaped so as to offer greater resistance to the flow of a fluid from the outlet side to the inlet side of the plate member than to the flow of fluid from the inlet side to the outlet side of the plate member. In this way, as the plate member is moved in a reciprocating motion in the chamber, the net flow of fluid is from the inlet to the outlet side of the pump. Whilst this pump creates a net flow to the outlet, it requires further apparatus to prevent unwanted 'back flow' in the case when there is a greater pressure at the outlet than at the inlet or to prevent uncontrolled forward flow when there is a greater pressure at the inlet than at the outlet.

In the art of 'pump chamber' pumps, there is provided a pump chamber or volume that may be varied by an actuator and having one-way valves at both inlet and outlet, both valves being arranged to allow flow in the direction from the inlet to the outlet. The inlet valve is located between the pump chamber and the reservoir and the outlet valve is located between the pump chamber and the delivery site. In use, the tubing between at least the inlet valve (and usually from reservoir to delivery site) and the outlet valve is filled with liquid, and the pump chamber volume is alternately increased (to ingest further liquid through the inlet valve whilst the outlet valve is closed) and reduced (to expel that ingested volume of liquid through the outlet valve whilst the inlet valve is closed) by the action of the actuator. The one-way valve therefore acts to rectify the flow. The actuator may be a solenoid, a piezoelectric actuator or other type of electromechanical actuator. The pump is resistant to "back flow" by the arrangement of the valve mechanisms, however additional components are required to prevent uncontrolled forward flow.

A more recent variant of such pumps is described by Stemme, see for example, WO-A-94/19609. In this device, there is provided a pump chamber, in use filled with liquid, in which the inlet and outlet one-way valves of conventional 'pump chamber' pumps are replaced by fluid flow constrictions. These flow constrictions have, for a given flow through them, a larger pressure drop in one flow direction (which he terms the 'nozzle direction') than in the opposite flow direction (which he terms the 'diffuser direction'). So Stemme replaces conventional 'one-way' valves that have a better flow rectification action with valves that have no requirement for mechanical motion and are therefore more robust than the standard displacement pumps.

This pump therefore requires auxiliary means to prevent undesirable 'back-flow' and forward flow when an opposing hydrostatic pressure head (that is, a pressure difference against which the pump in use does hydrostatic work) is present. From the description, further auxiliary means appear desirable to suppress the pulsatile nature of the liquid flow, so it appears that the pump operates at low cycle frequencies.

In both the Stemme pump and the 'pump chamber' pumps having conventional one-way valves ('conventionally valved'), effective pumping is based upon the incompressibility of the liquid and the mechanical stiffness of the pump chamber. Both require components providing partial or complete flow rectification (valve action) at both the inlet and the outlet (whether those components are conventional one-way valves or the 'flow restrictors' of Stemme). They need components providing valve action at the inlet in order that such liquid incompressibility results, on decrease of the pump chamber volume, in expulsion of liquid through the outlet. They need components providing valve action at the outlet in order that such liquid incompressibility results, on increase of the pump chamber volume, in ingestion of liquid through the inlet valve. Both forms have a relatively complex three-dimensional form, which is relatively expensive to produce.

The reliance of these pumps upon mechanically stiff pump chambers and the near-incompressibility of the liquid being pumped means that, for example, if air or other gas is present in the pump chamber, some or all of the volume reduction on the 'ejection' stroke is used up in compressing the (easily-compressible gas) before expelling liquid through the outlet and some or all of the volume increase on the 'ingestion' stroke is used up in rarefying the (easily-rarefied) gas before ingesting liquid through the inlet. Consequently a reduced, or zero, quantum of liquid is actually pumped per cycle of operation and pumping capability is reduced or lost. Further, since the bubble expansion is not, in general, equal to the bubble compression (due to a process known from the ink jet printing art as 'rectified diffusion'), this also creates increasing errors in the fluid volume delivered per cycle. These failings are particularly serious in the case of liquid drug delivery, especially those drugs that are kept in a cool (often refrigerated) state until the time of use in order to extend their useful shelf life. On pump delivery of such drugs to the patient, the drug is exposed to higher ambient temperatures, the solubility of any air dissolved in the drug liquid decreases, and some of the dissolved air often comes out of solution in the form of air bubbles. This effect makes accurate delivery of such drugs very difficult by such 'pump chamber' pumps. As can be appreciated, 'pump chamber' pumps are not, to the knowledge of the present inventors, able to pump liquid and gas mixtures effectively.

One aspect of fluid pump devices, which significantly increase their usefulness for liquid delivery, is their ability to self-prime. When the inlet pipe is placed within a body of liquid to be pumped, a volume of air is trapped between the liquid meniscus in the inlet pipe and the outlet. Self-priming occurs when this air is displaced through the pump from the inlet to the outlet by the action of the pump mechanism, thereby drawing the liquid at the inlet through the pump to the outlet.

It is recognised by the applicant that "fluid" has a dual meaning of both a gas, such as air, and a liquid. Also recognised is that a fluid pump is able to pump both gas and liquid, and further that a fluid pump is capable of self-priming.

There are also known in the art apparatus and methods for atomising liquids into droplets, in which the liquid is brought to one face of a membrane having orifices, which membrane is then vibrated at high frequency. One such apparatus is described in patent application EP-A-0 655 256 to provide the transport of bulk liquid from one face to the opposing face of such a membrane before such atomisation occurs. In this art however, the liquid is transported from a region of higher hydrostatic pressure to a region of lower hydrostatic pressure. The role of the vibration appears to assist the natural liquid flow (in the direction encouraged by the hydrostatic pressure difference) through the orifices by overcoming the opposition of the menisci that are initially present at those orifices. There is no teaching in that application of means to prevent 'back-flow' that otherwise would occur when such an opposing hydrostatic pressure is present.

A simple vibrating pump is described by Maehara in JP-A-58-140491 in which a pressurising chamber has, as an outlet, a nozzle plate through which a number of nozzles have been bored. The nozzle plate is caused to vibrate by a piezoelectric oscillator such that the fluid in the chamber is ejected through the nozzle plate as a spray. There is no teaching of any means for preventing 'backflow'.

EP-1099853 discloses a diaphragm breakage protection system in a reciprocating diaphragm pump. The pump is provided with a chamber in which a moveable diaphragm is mounted. An exit location from the chamber is covered with a moveable plate, in which a series of perforations are provided. The perforated plate covers the exit point from the chamber and prevents the diaphragm, when in its deflected state, passing into the outlet. When in the at rest position, the diaphragm and the perforate element are spaced apart, thus allowing either forward or backward flow through the perforate element. Furthermore, as the pump includes a sealed chamber, the operation of the pump is then intolerant to the presence of air within the chamber, such that the performance of the pump would be quickly depreciated should air enter the chamber.

The present invention seeks to overcome at least some of the aforementioned disadvantages of the known peristaltic fluid or liquid pumps and the 'pump chamber' liquid pump and the liquid 'atomiser' device and to provide a smaller or simpler pump than hitherto has been provided.

According to a first aspect of the present invention, there is provided a method of pumping a fluid, the method comprising:

supplying a fluid to at least one side of a perforate element, the perforate element having one or more perforations and being adjacent, on the one side, to at least one closure assembly which prevents fluid flow through the one or more perforations when the pump is not in use; and providing a net transfer of fluid through the perforate element in the direction from the one side to the other side of the perforate element by alternately displacing the perforate element in directions towards and away from the one side and by alternately displacing the at least one closure element in directions towards and away from the one side.

According to a second aspect of the present invention, there is provided a pump for pumping a fluid, the pump comprising:

an inlet;

an outlet;

a perforate element disposed between the inlet and the outlet, the perforate element having one or more perforations;

at least one closure assembly disposed adjacent said perforate element on the one side and having at least one closure aligned with at least one of the perforations in the perforate element to close said perforation(s) when the pump is not in use, and a drive means for alternately displacing the perforate element in directions towards the inlet and outlet sides of the pump.

Thus, the present invention provides a method of pumping and a pump which prevents unwanted forward flow and back flow when not in use and which, as no sealed chamber is required, ensures that the pump is tolerant to the presence of air or gas bubbles within the liquid to be pumped.

When the displacements are in phase, fluid is permitted to flow through the perforation(s) as the closure assembly moves away from the perforate element at the peak in the cycle of the perforate element. The difference between the vibration amplitudes of the perforate element and the closure assembly is the valve open gap.

When the displacements are out of phase, the valve open gap is the sum of the vibration amplitudes of the perforate element and the closure assembly. In this arrangement, the perforation(s) is (are) open when the membrane is moving away from the closure assembly and closed when the membrane is deflected towards the closure assembly.

Preferably the closure assembly is displaced out of phase with respect to the perforate element.

In this regard, out of phase motion is defined as when the phase angle between the motion of the closure assembly and of the perforate element is non-zero. Another definition of out of phase relative motion which also applies is when the perforate element is moving periodically towards and away from the closure assembly. It is important to note that such motion does not necessarily require touching contact between the closure assembly and the perforate element on each cycle, as may occur for non-periodic motion of the closure assembly for example. The motion in the out of phase mode is most regular when the phase angle is 180°, and touching contact is achieved between the closure assembly and the perforate element on each cycle.

It is preferable for the displacements of the perforate element and/or the closure assembly to be resonant.

Preferably, the inlet is the one side of the perforate element at which the fluid has the lower hydrostatic pressure and the outlet is the other side of the perforate element at which the fluid has the higher hydrostatic pressure.

Preferentially, the perforate element takes the form of a thin membrane or plate with perforations therethrough (such as may be fabricated for example by electroforming, laser machining or discharge machining operations). Alternatively, the perforations could be formed by simple mechanical drilling.

The closure assembly may take the form of a spring and valve mass. The spring may be a cantilever beam or may comprise a central plate portion for contacting the valve mass and having a plurality of legs extending between the plate portion and the perforate element.

The drive means may take the form of an electromechanical actuator and an electronic drive circuit that, in use, is mechanically coupled to the perforate element. Preferentially the drive means is capable of generating high accelerations of the perforate element but with small physical displacements, as will be explained further by way of the example below. Further, the drive means preferentially displaces the perforate element in such a manner that following one complete motion (that is a motion substantially in the direction towards and away from the inlet), the perforate element is restored to its initial position. For these purposes piezoelectric, piezomagnetic or electrostrictive actuators are highly desirable; their rapid response characteristics allow high accelerations, whilst their physical displacements are very small.

The perforate element, the electromechanical actuator of the drive means and the closure assembly taken together are hereinafter referred to as the 'pump head'. By integrating the electromechanical actuator, particularly where it is of piezoelectric or electrostrictive type, with the perforate element a 'solid state' pump head of very small size and low power consumption and operating to pump fluid with very small motional displacements can be provided.

Preferably, the fluid is pumped from a first region (the pump inlet) at which it is at a relatively low hydrostatic (as distinct from hydrodynamic) pressure to a second region (the pump outlet) at which it is at a relatively high hydrostatic pressure. Fluid may be loaded to either the inlet side of the pump or to both sides of the pump.

The invention will now be described with reference to the following drawings, in which:

FIG. 3 shows a schematic representation of one arrangement of the perforate element and the closure assembly of the present invention;

Figure 6:
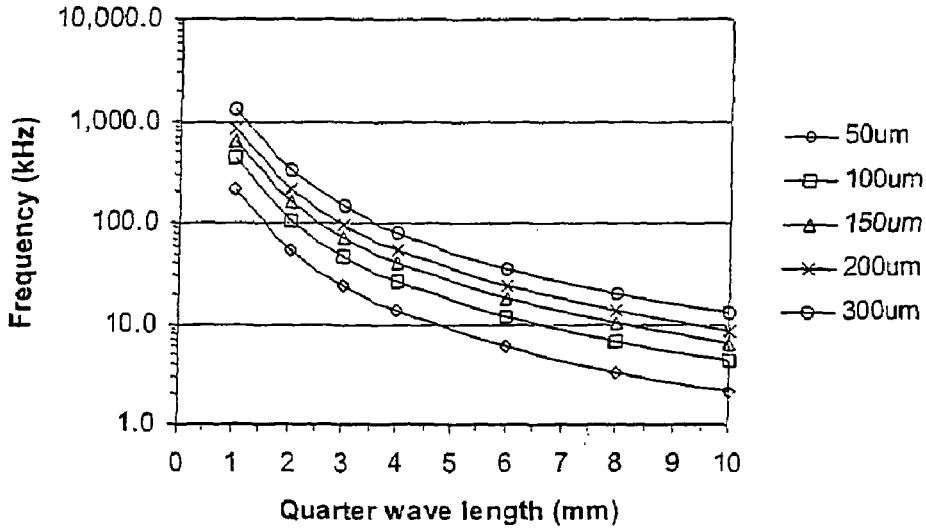
Figure 7:
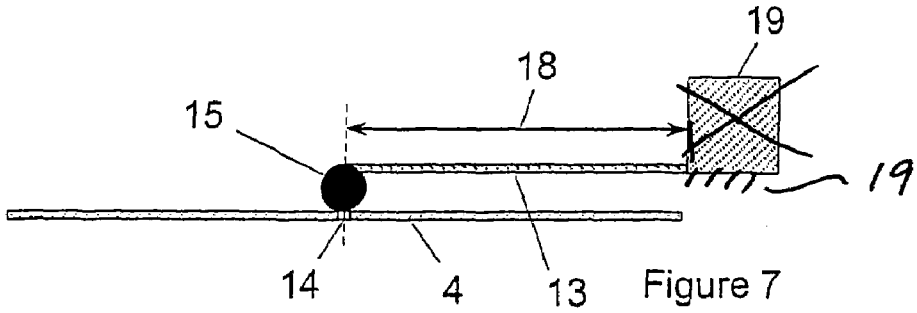
Figure 12:
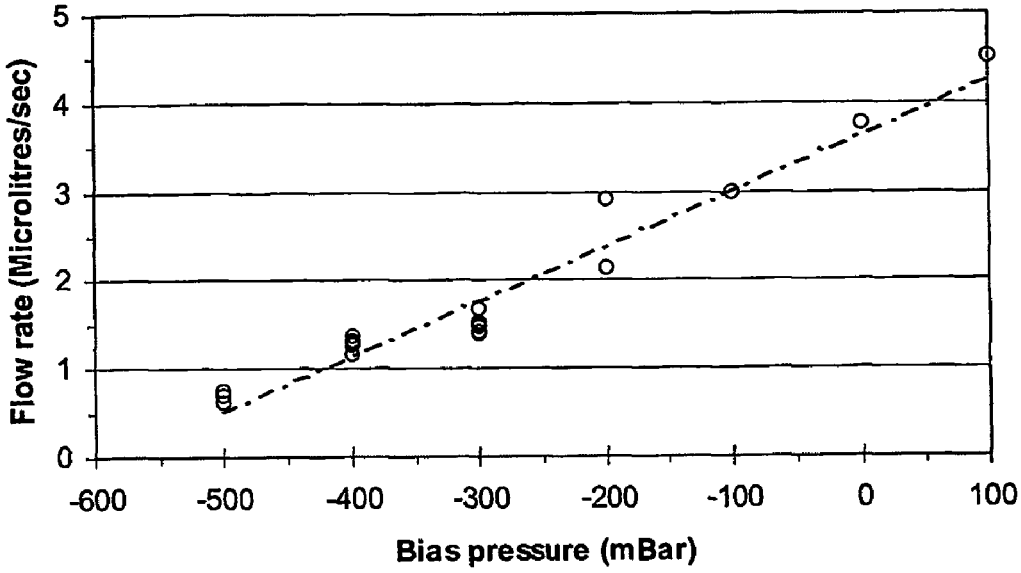
Figure 13A:
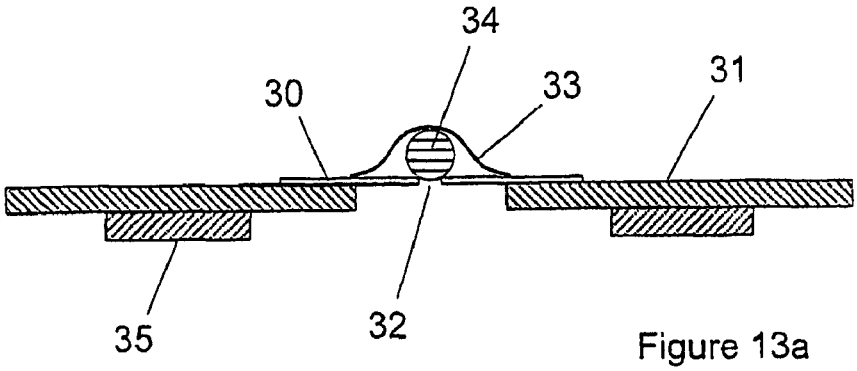
Figure 13B:
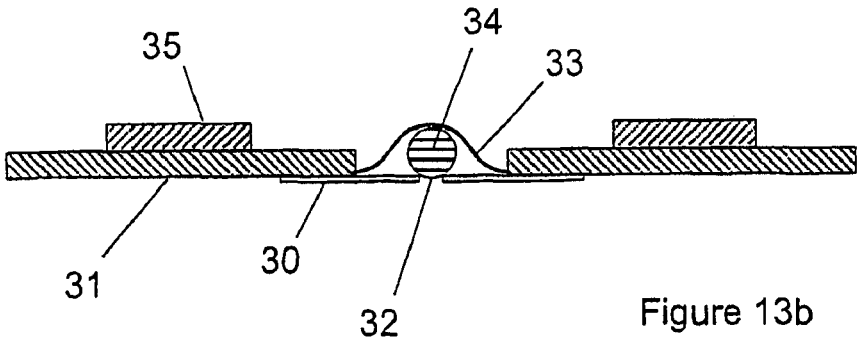
Figure 14A:
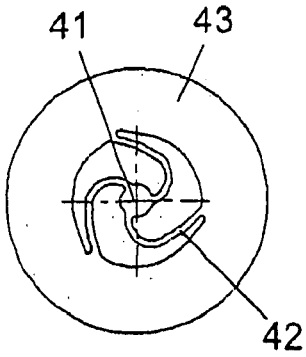
Figure 14B:
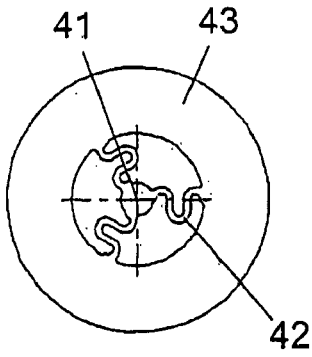
Figure 14C:
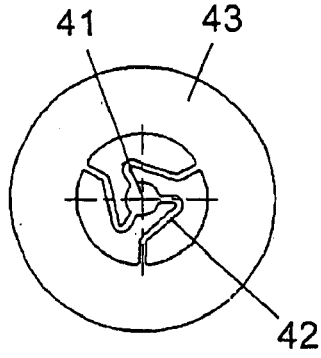

FIGS. 4*a* and 4*b* show a schematic representation of the pumping in a first mode;

FIGS. 5*a* and 5*b* show a schematic representation of pumping in a second mode;

FIG. 6 is a graph indicating mode frequency as a function of quarter wavelength of the valve spring indicated in FIG. 3;

FIG. 7 shows the construction of one form of a closure assembly;

FIG. 8 shows a three dimensional image, taken with a Polytec Scanning Vibrometer PSV 300 (Polytec GmbH, Walbronn, Germany), showing the perforate element and the closure assembly in the first mode (maximum displacement);

FIGS. 9*a* and 9*b* show the vibration amplitude and phase relationship in the first mode;

FIG. 10 is a three dimensional image taken with a Polytec Scanning Vibrometer PSV 300 (Polytec GmbH, Walbronn, Germany) the perforate element and closure assembly in the second mode maximum displacement;

FIGS. 11*a* and 11*b* are representative of the vibration amplitude and phase relationship in the second mode;

FIG. 12 is a graph indicating the performance of a resonant valve;

FIGS. 13*a* and 13*b* show another schematic representation of the perforate element and closure assembly; and FIGS. 14*a*, 14*b* and 14*c* are schematic plan views of other forms of spring.

Figure 1:
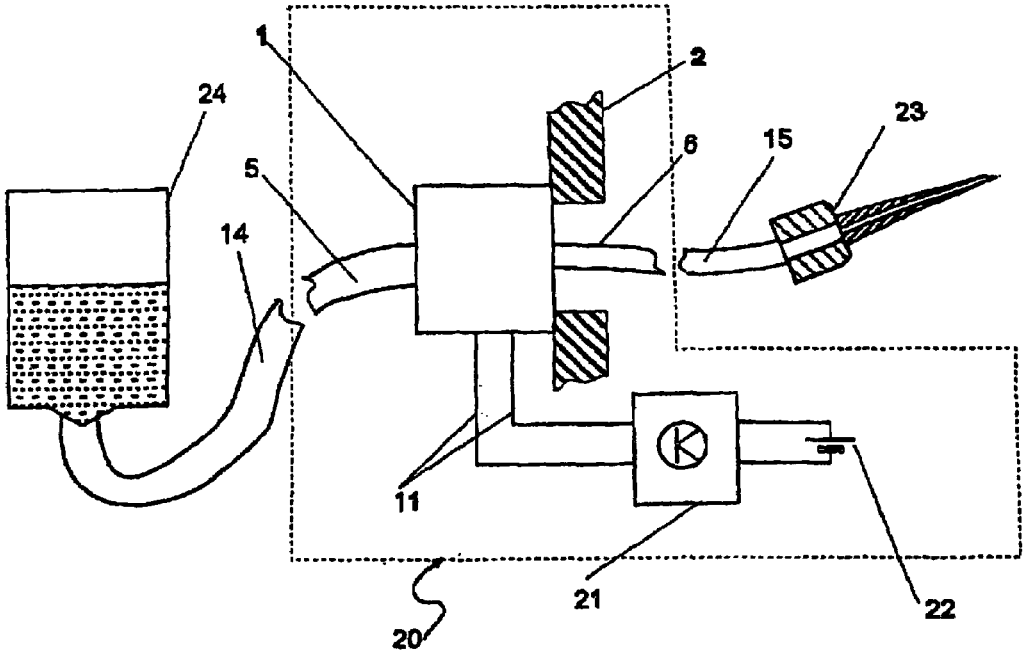
FIG. 1 shows a pump according to the present invention.

In FIG. 1 is shown a pump 20 comprising: a pump head 1 having an inlet 5 and an outlet 6, an electrical drive circuit 21 and a power supply 22 to which pump head 1 is electrically connected by means of wires 11. By way of example only, a fluid reservoir 24 is connected to that pump by means of inlet tubing 14, and an outlet 23, in the form of a syringe needle, is connected to that pump by means of outlet tubing 15. In use, these are typically arranged so that the hydrostatic pressure of fluid at inlet 5 is lower than the hydrostatic pressure presented at outlet 6 although this does not have to be the case. (Most typically the pressure in reservoir 24, for example in ambulatory drug pumps, will be lower than that at the outlet needle 23.)

Figure 2:
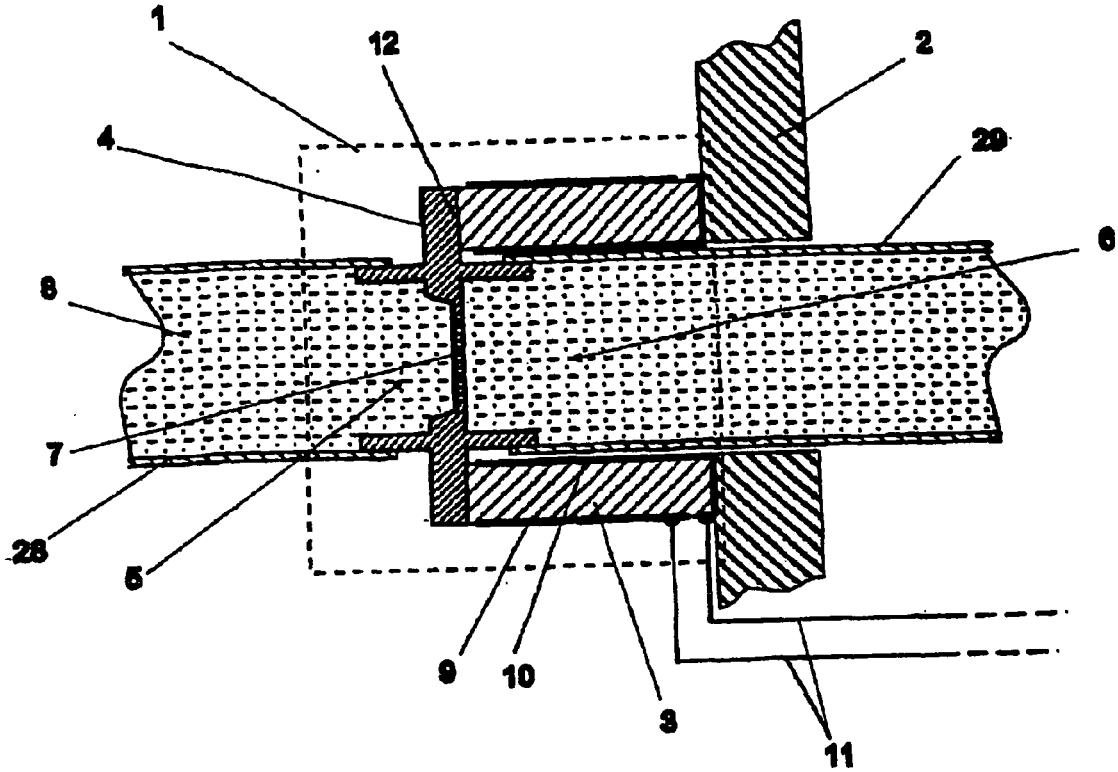
FIG. 2 shows detail of a pump head according to the present invention, within the pump.

FIG. 2 shows detail of one form of pump head 1, without the closure assembly 13 shown in FIGS. 3,4,5,7,8 and 10, together with ancillary components of an overall pump system. Pump head 1, which has overall cylindrical symmetry, is mounted on a mounting body 2. It comprises an electromechanical actuator 3 mechanically coupled to a perforate element 4 having perforations in region 7. Perforate element 4 has opposing inlet 5 and outlet 6. Region 7 of perforate element 4 is typically formed as a stainless steel membrane or plate of thickness typically in the region of 20 μm to 200 μm and diameter typically 1 mm to 5 mm. Through the thickness of region 7, perforations, whose minimum size is typically in the range 3 μm to 100 μm, are formed by laser drilling. Alternative membrane or plate materials include electroformed nickel; in that case the perforations may be introduced as a result of the electrochemical growth process of the membrane, rather than later introduced. When using electroformed nickel for drug delivery applications, it is generally desirable to coat the nickel and perforations with a layer of a relatively inert material such as gold or para-xylylene ('parylene') so that nickel does not become extracted into the drug formulation being pumped. That layer must be applied thinly enough that it does not block the perforations. Alternatively, the material may be formed from a stainless steel, or other suitable metal, through which the perforation(s) are mechanically drilled. In this case, the perforations are typically in the range 100 μm to 500 μm. The remaining portion of perforate element 4 may be formed, for example, of stainless steel; its dimensions (except where specified) are not critical but preferably are chosen such that the total mass of body 4 is of similar magnitude to, or less than, that of the actuator 3.

Actuator 3 is an electromechanical actuator in the form of a cylindrical tube of piezoelectric ceramic material mounted on mounting body 2. Actuator 3 has electrodes 9 and 10 on the inner and outer cylindrical surfaces. Electrode 10 'wraps around' one end of the tube for easier electrical connection, but unlike electrode 9 it does not substantially extend across the outer cylindrical surface of the actuator. It is connected by wires 11 to an electrical drive circuit (not shown). Actuator 3 is conveniently a piezoelectric ceramic of material grade PIC151 from Lambda Physik of Germany (or some similar grade from other suppliers) and is 4 mm in outside diameter, 2.5 mm in internal diameter, and 12 mm long.

In use, the fluid 8 to be pumped is brought at relatively low hydrostatic pressure to inlet 5. As described with reference to FIG. 1, this is typically, though not necessarily, by means of an inlet tube 28. Similarly, typically though not necessarily, fluid at relatively high pressure is transported away from outlet 6 by means of outlet tube 29.

Drive circuit 21 provides electrical excitation of actuator 3 to cause lengthways contractional and extensional displacements of an end surface 12 of actuator 3, and, in consequence, perforate region 7 of perforate element 4 is displaced alternately between directions towards and away from inlet 5. These alternating motions occur rapidly. In resonant motion, the typical frequency for the dimensions of actuator 3 given above is (when the excitation is continuous and resonant rather than intermittent) approximately 100 kHz, but the precise frequency of operation depends upon the precise geometry of the actuator 3 and details of the mounting of actuator 3 to mounting body 2. Intermittent operation is also possible, in which case it is more sensible to think of 'rise times' of the displacement motion rather than operating frequency; in this case 'rise times' are typically in the μs regime. The displacements of perforate element 4 are usually small, typically less than 1 μm. However the high frequency (or short 'rise time') combine with those displacements to produce high accelerations, typically in the range $10^4$ m/s$^2$-$10^6$ m/s$^2$. The higher values of acceleration are most conveniently achieved in a continuously oscillating system in which the mechanical system of actuator 3 and perforate element 4 is mechanically in resonance.

FIG. 3 shows a schematic representation of the centre of perforate element 4 and includes, at least in part, region 7 in which the perforations are formed. The perforate element 4 is provided with a single nozzle 14 which, in this example, is provided with parallel sides such that the cross sectional area of each side of the nozzle 14 is the same. A closure assembly 13, taking the form of a cantilever spring, is located such that a closure, in this case a substantially spherical mass 15, is adjacent one side of the nozzle 14. The closure assembly is mounted to an external solid fixing point 19 (see also FIG. 7) and is set with a sufficient pre-load force to seal the nozzle against forwards and backwards flow.

The interaction between these reciprocating displacements of perforate region 7, the closure assembly 13 and the fluid 8 can then produce a pumping action in one of two ways, according to the detailed mode of excitation of the perforate element or membrane 4 and the closure assembly, as further described with reference to FIGS. 4*a*, 4*b*, 5*a* and 5*b* below. Description of operation is made in the case where the inlet side of the perforate element is at relatively low hydrostatic pressure and the outlet side at relatively high hydrostatic pressure.

FIGS. 4*a* and 4*b* show a schematic representation of the pumping action in the first mode in which the motion of the perforate element or membrane 4 and the closure member 13 is resonant and in phase as shown by arrows 16. Whilst it is preferable for the motion to be resonant, it is not essential. In this arrangement, on each cycle, the membrane 4 drives the valve mass 15 attached to the closure assembly 13 up and down, at resonance and in phase with the motion of the membrane. In an alternative arrangement not shown by the figures, the closure assembly may be driven not by the membrane but a separate driving means. In FIG. 4A, the valve is opened as the valve mass 15 moves away from the nozzle 14 in the direction of arrow 13*a*. In FIG. 4*b*, the valve is shown closed as the closure assembly 13 moves towards the nozzle 14 in the direction of arrow 18*b*. It should be noted that the valve open gap 24 is the difference between the vibration amplitudes of the valve mass 15 and the membrane 4. In this arrangement, the fluid is pumped in the direction shown by arrow 16 from the open side 25 or region of lower hydrostatic pressure of the nozzle to the side 25 or region of higher hydrostatic pressure, on which the closure assembly is located. Thus, the region of lower hydrostatic pressure should be located on the open side of the nozzle 14 (the lower side as shown in FIGS. 4*a* and 4*b*).

In the arrangement shown in FIGS. 5*a* and 5*b*, on each cycle, the membrane drives the valve mass 15 up and down at resonance and out of phase shown by arrows 16' with the membrane motion. As with the first mode, in an alternative arrangement not shown by the figures, the closure assembly may be driven not by the membrane but a separate driving means. Again, resonant motion is preferred but is not essential. In FIGS. 5*a* and 5*b*, the valve open and valve close positions of the cycle are reversed when compared to the arrangement shown in FIGS. 4*a* and 4*b*, so that, the nozzle 14 is closed when the perforate element or membrane 4 is deflected towards the valve mass 15 in the direction of arrow 22*a*; and the nozzle 14 is open while the membrane 4 is moving away from the valve mass 15 in the direction of arrow 22*b*. In this arrangement, the valve open gap 4 is the sum of the vibration amplitudes of the membrane 4 and the valve mass 15 in the out of phase motion. The fluid is caused to flow in the direction shown by arrow 17, that is from the side 25 of the nozzle on which the closure assembly 13 is located to the open side 25 of the nozzle. In this case, the region of lower hydrostatic pressure should be on the same side 25 of the nozzle as the closure assembly 13; and the region of lower hydrostatic pressure should be on the side 25 of the nozzle opposite the closure assembly. The profile of the nozzle 14 can be any suitable shape. However, it is preferably for the cross-section to be circular and for the valve mass 15 to be spherical.

Whilst only a single closure assembly having a single valve mass has been described in these examples, it is envisaged that plural closure assembly may be used and that each closure assembly may have more than one valve mass.

The following dispersion relation has been used to specify the valve spring:

$$\omega = k^2 E h^2 / (12\rho(1-\sigma^2))$$

where ω is the resonant frequency of the nozzle valve, $k=2\pi/\lambda$, and E is the Young's modulus of the valve spring, h is the thickness of the valve spring, ρ is the density of the valve spring and σ is the Poisson's ratio for the valve spring. The geometry of the valve spring is such that the length of the valve spring is controlled to define the wavelength of the valve spring vibration.

For resonant motion of the closure assembly with the membrane, the closure assembly 13 may be characterised by the solution to a resonant beam model in which the quarter wavelength (or, in fact, any wavelength having the form $\lambda(1/4+n/2)$ where n is zero or any positive integer) of the vibration is matched to the length of the beam and the stiffness is matched to a chosen mode frequency of the nozzle plate 4.

For a stainless steel beam, where the Young's modulus (E) is $2.0\ 10^{11} N/M^2$, this relationship may be used to generate the frequencies shown in FIG. 6, where mode frequency is expressed as a function of quarter wavelength and beam thickness.

The applicants have created devices which have operated at approximately 70 kHz, using 100 μm thick beams and, in this arrangement, the quarter wavelength of such a vibration is approximately 2.4 mm. Thus, to optimise the resonance of this valve spring at 70 kHz, the length of the valve tip 18 shown in FIG. 7 could be 2.4 mm (n=0), 7.2 mm (n=1), 12.0 mm (n=2), etc from its mounted position. The closure assembly 13 can be seen mounted in a rigid spring mount 19.

The resonant modes of operation were investigated by the applicants with a laser vibrometer using simple laboratory apparatus to report the valve structure.

FIG. 8 is a representation showing the three dimensional image of the perforate membrane 4 with the closure assembly 13 highlighted as a segment, intercepting the centre of the membrane to cover the single nozzle 14. By studying the locus of points defined in the cross-section A-A, it can be seen from this Figure that the displacement amplitude of the membrane 4 and the closure assembly 30 is between 600 nm and 900 nm over the nozzle region, thus indicating a nozzle opening of no more than 300 nm.

From section A-A, it is also possible to determine the nozzle opening and this is indicated in FIG. 9*a*. This shows the peak amplitude and vibration across the diameter of the membrane 4, intercepting the closure element 13 at the centre. From this Figure, it can be seen that the nozzle opening aperture us very small, typically no more than 100 nm. By analysing the same section across the membrane for phase information, the applicants have obtained the graph shown in FIG. 9*b*. This indicates that the membrane and the valve are both vibrating in phase with each other, and thus 90° out of phase with the AC drive signal. Therefore this valve is operating in the first resonant mode.

FIG. 10 shows a similar representation to that of FIG. 8 but in which the membrane 4 was oscillated at a frequency of 86 kHz. In this mode, the length of the valve tip 18 is 7.0 mm. At 86 kHz, the 100 μm thick valve spring has a quarter wavelength of 2.3 mm and therefore the valve tip correlates to 0.76 λ (n=1). From FIG. 10, it can be seen that the closure assembly 13 is vibrating with much greater amplitude of vibration (in excess of 1 μm) relative to the membrane. By analysing the section B-B across the diameter of the membrane the applicants have obtained the information shown in FIGS. 11*a* and 11*b*. FIG. 11*a* shows that the opening aperture of the nozzle valve is at least 500 nm. In FIG. 11*b*, it can be seen clearly that the closure assembly is vibrating at approximately 180° out of phase with the membrane. According to this second mode of vibration this is resonant, out of phase operation. In this second mode, it has been found that, when operated to pump, approximately 0.7 micro liter per second can be pumped against a back pressure of 500 mbar (the pressure difference between the outlet and the inlet). It was also shown to deliver forward pump flow at a back pressure up to 600 mbar and this can be seen from FIG. 12 which is a graph indicating the performance of an out of phase resonant valve in which the nozzle diameter is 250 μm and the fluid being pumped is saline.

In another arrangement of a perforate element and a closure assembly shown in FIG. 13*a*, a perforate element 30 is mounted on one side of a stainless steel substrate 31, the perforate element 30 having a perforation 32 therethrough. A spring 33 extends over the perforation 32 in such a way that it retains a closure member 34, in this case a sapphire sphere, so that the sphere rests in and seals around the edge of perforation 32. On the other side of the stainless steel substrate 31 to the perforate element 30, a piezoceramic annulus 35 is attached. By applying an alternating electrical signal between electrodes on the upper and lower faces of the piezoelement 35, the substrate 31 is caused to vibrate thereby causing the valve mass 34 to be moved alternatively towards and away from the perforation 32. The spring 33, shown in greater detail in FIGS. 14*a*, 14*b* and 14*c*, comprises a central plate portion 41 to which a series of legs 42 are attached. The legs are connected to an annular portion 43 which is attached to the perforate element 30. The valve mass 34 is held in compression between the central plate 41 and the perforate element 30. The mass is spherical and so is free to rotate, while always ensuring that the circular perforation 32 is fully sealed. The mass 34 is centered on the centre of the perforation, since the hub portion 31 does not apply any specific lateral constraint. This improves the tolerance of the manufacturing process, since the perforation 32 and valve mass 34 are self aligning.

In this arrangement, pumping is believed to operate when the valve mass 34 and the perforate element 30 vibrate in out of phase motion. This is particularly true when the valve mass 34 is stationary and the perforate element 30 is moving towards and away from it.

In FIG. 13*b*, the piezo element 35 and perforate element 30 have swapped sides of the stainless steel substrate, but in each of FIGS. 13*a* and 13*b*, pumping occurs from the side of the perforate element to which the mass 34 is positioned towards the other side.

The provision of valve mass 34 sealing perforation 32 when at rest ensures that unwanted forward flow through the perforate element is prevented and unwanted back flow, in this example upwardly through the perforate element 30, is prevented, up to a certain limit defined by the spring pre-load force provided by spring 33, when it is deflected at rest by approximately the diameter of the valve mass 34.

FIGS. 14*a*, 14*b* and 14*c* show three different types of spring 33, but each of these has a central plate portion 41 and a plurality of legs 42 extending from this plate to an annular portion 43, which, in use, is attached to the perforate element 30.

The invention has been described without reference to fluid flow sensing. Without flow sensing, flow rate of the pump as described above is affected by the magnitude of the hydrostatic head against which the pump is delivering fluid (see FIG. 12 for example), so that flow rate is not precisely known. However, known flow sensing means such as bias pressure measurement, thermal pulse injection or nephelometric or other forms of optical-scattering sensing means may be used in combination with the invention as described above. The output of such sensors may be used to measure actual flow rate and to control and/or maintain a desired flow rate within the range of hydrostatic pressures against which a particular embodiment of the pump itself can deliver fluid. In this way accurate fluid volume (or dose) delivery can be provided.

The invention claimed is:

1. A method of pumping a fluid, the method comprising:

supplying a fluid to at least one side of a perforate membrane, the perforate element having one or more perforations and being adjacent, on the at least one side, to at least one closure assembly having a closure mass which seals against and prevents fluid flow through the one or more perforations when the pump is not in use; and providing a net transfer of fluid through the perforate element in the direction from the one at least one side to the other side of the perforate membrane by alternately displacing the perforate membrane in directions towards and away from the at least one side and by alternately displacing the at least one closure assembly in directions towards and away from the at least one side, wherein during the displacing step the closure assembly is displaced out of phase with the perforate membrane.

2. A method according to claim 1, wherein during the displacing step the displacements are resonant.

3. A method according to claim 1, wherein during the displacing step the perforate membrane drives the displacement of the closure assembly.

4. A method according to claim 1, wherein during the displacing step the fluid is pumped from a region of lower hydrostatic pressure to a region of higher hydrostatic pressure.

5. A pump for pumping a fluid, the pump comprising:

an inlet;

an outlet;

a perforate membrane disposed between the inlet and the outlet, the perforate membrane having one or more perforations;

at least one closure assembly disposed adjacent said perforate membrane on at least one side thereof and having at least one closure mass aligned with at least one of the perforations in the perforate membrane to close said perforation(s) when the pump is not in use, and a drive means for alternately displacing the perforate membrane in directions towards the inlet and outlet sides of the pump, wherein the closure assembly is displaced out of phase with the perforate membrane.

6. A pump according to claim 5, wherein the displacements are resonant.

7. A pump according to claim 5, wherein the inlet is the at least one side of the perforate membrane at which the fluid has a lower hydrostatic pressure and the outlet is the other side of the perforate membrane at which the fluid has a higher hydrostatic pressure.

8. A pump according to claim 5, wherein the perforate membrane has perforations passing therethrough from the inlet to outlet.

9. A pump according to claim 5, wherein the drive means takes the form of an electronic device circuit and an electromechanical actuator mechanically coupled to the perforate membrane.

10. A pump according to claim 5, wherein the drive means takes the form of an electronic drive circuit and piezoelectric material in the perforate membrane.

11. A pump according to claim 5, wherein the closure assembly comprises a spring attached to the closure mass for closing the perforation(s).

12. A pump according to claim 11, wherein the spring includes a central plate portion for contacting the closure mass and having a plurality of legs extending between the plate portion and the perforate membrane.

13. A pump according to claim 5, further comprising drive means attached to the closure assembly.

14. A pump according to claim 8, wherein the membrane has a thickness in a range of about 20 um to 200 um.

15. A pump according to claim 5, wherein the perforations in the membrane have a diameter in a range of about 1 mm to about 5 mm.

* * * * *